US012599947B2

(12) United States Patent
Urakami et al.

(10) Patent No.: US 12,599,947 B2
(45) Date of Patent: Apr. 14, 2026

(54) ROLLER EXCHANGE MECHANISM FOR REDUCTION ROLL APPARATUS

(71) Applicants: TOYOTA JIDOSHA KABUSHIKI KAISHA, Toyota (JP); PRIMEARTH EV ENERGY CO., LTD., Kosai (JP); Prime Planet Energy & Solutions, Inc., Tokyo (JP)

(72) Inventors: Taichi Urakami, Nisshin (JP); Seiji Ishizu, Toyota (JP); Kazutoshi Iwata, Ichinomiya (JP); Masakazu Umehara, Toyota (JP); Shingo Mori, Kurokawa-gun (JP); Naoya Kishimoto, Nagoya (JP)

(73) Assignees: TOYOTA JIDOSHA KABUSHIKI KAISHA, Toyota (JP); PRIMEARTH EV ENERGY CO., LTD., Kosai (JP); PRIME PLANET ENERGY & SOLUTIONS, INC., Tokyo (JP)

( * ) Notice: Subject to any disclaimer, the term of this patent is extended or adjusted under 35 U.S.C. 154(b) by 280 days.

(21) Appl. No.: 18/225,285

(22) Filed: Jul. 24, 2023

(65) Prior Publication Data

US 2024/0033796 A1 Feb. 1, 2024

(30) Foreign Application Priority Data

Jul. 28, 2022 (JP) ..... 2022-120638

(51) Int. Cl.
*B21B 31/10* (2006.01)

(52) U.S. Cl.
CPC ..... *B21B 31/103* (2013.01)

(58) Field of Classification Search
CPC ..... B21B 31/103; B21B 31/08; B21B 31/10
See application file for complete search history.

(56) References Cited

U.S. PATENT DOCUMENTS 5,590,557 A * 1/1997 Keller ..... B21B 31/08 72/248
5,660,068 A * 8/1997 Yamamoto ..... B21B 31/103 72/239
2002/0078728 A1* 6/2002 Mukaigawa ..... B21B 31/103 72/239

(Continued)

FOREIGN PATENT DOCUMENTS

CN 110814057 A 2/2020
CN 111151581 A 5/2020

(Continued)

*Primary Examiner* — Teresa M Ekiert
(74) *Attorney, Agent, or Firm* — Dinsmore & Shohl LLP

(57) ABSTRACT

A roll exchange mechanism for a reduction roll apparatus, capable of contributing to simplifying work for replacing a roller is provided. A roll exchange mechanism for a reduction roll apparatus according to the present disclosure includes a rail member disposed parallel to a rotation shaft of a roller of the reduction roll apparatus, a placement part disposed in a support frame of a roll unit and configured to be placed on the rail member, a receiving part disposed in an apparatus frame of the reduction roll apparatus and configured so that the rail member is placed thereon, and an opening formed in the apparatus frame of the reduction roll apparatus and configured so that the roll unit can be inserted therein and removed therefrom.

1 Claim, 7 Drawing Sheets

(56) References Cited

U.S. PATENT DOCUMENTS

| | | | | |
|---|---|---|---|---|
| 2005/0000263 | A1* | 1/2005 | Wittkopf | B21B 31/103<br>72/239 |

FOREIGN PATENT DOCUMENTS

| | | | |
|---|---|---|---|
| JP | S61-111603 | U | 7/1986 |
| JP | H04-9219 | A | 1/1992 |
| JP | 2012-232332 | A | 11/2012 |

* cited by examiner

ROLLER EXCHANGE MECHANISM FOR REDUCTION ROLL APPARATUS

CROSS REFERENCE TO RELATED APPLICATIONS

This application is based upon and claims the benefit of priority from Japanese patent application No. 2022-120638, filed on Jul. 28, 2022, the disclosure of which is incorporated herein in its entirety by reference.

BACKGROUND

The present disclosure relates to a roll exchange mechanism for a reduction roll apparatus.

A reduction roll apparatus is used to roll an electrode material (i.e., to press and stretch an electrode material with rollers) applied on a metal foil when, for example, lithium-ion batteries are manufactured. Such a reduction roll apparatus is configured so that a member to be rolled (i.e., a member to be pressed and stretched) is made to pass between two rollers. Note that due to the surface of a roller being worn or damaged, the roller sometimes needs to be replaced with a new one. For example, Japanese Unexamined Patent Application Publication No. H4-9219 discloses a method for replacing two rollers together with new ones by using a hoist crane in which the two rollers are kept in a connected state.

SUMMARY

The applicant of the present disclosure has found the following problem. Regarding the method for replacing rollers disclosed in Japanese Unexamined Patent Application Publication No. H4-9219, large equipment such as a hoist crane is required to replace rollers, so that the work for replacing the rollers becomes complicated.

The present disclosure has been made in view of the above-described problem and provides a roll exchange mechanism for a reduction roll apparatus, capable of contributing to simplifying work for replacing a roller.

A first exemplary aspect is a roll exchange mechanism for a reduction roll apparatus, the reduction roll apparatus including: a roll unit including a roller, a rotation shaft of the roller, and a support frame configured to support the rotation shaft; and an apparatus frame to which the support frame is detachably connected, the roll exchange mechanism including:

a first rail member disposed parallel to the rotation shaft;

a placement part disposed in the support frame and configured to be placed on the first rail member;

a receiving part disposed in the apparatus frame and configured so that the first rail member is placed thereon; and an opening formed in a part of the apparatus frame and configured so that the roll unit can be inserted therein and removed therefrom, the part of the apparatus frame being located at an end thereof in a direction in which the rotation shaft extends, in which in a state in which the first rail member that is inserted into the opening of the apparatus frame and disposed parallel to the rotation shaft is placed on the receiving part, and the placement part is placed on the first rail member, the roll unit can be pulled outside of the reduction roll apparatus or pushed inside of the reduction roll apparatus along the first rail member through the opening of the apparatus frame.

According to the present disclosure, it is possible to provide a roll exchange mechanism for a reduction roll apparatus, capable of contributing to simplifying work for replacing a roller.

The above and other objects, features and advantages of the present disclosure will become more fully understood from the detailed description given hereinbelow and the accompanying drawings which are given by way of illustration only, and thus are not to be considered as limiting the present disclosure.

DESCRIPTION OF EMBODIMENTS

Specific embodiments to which the present disclosure is applied will be described hereinafter in detail with reference to the drawings. However, the present disclosure is not limited to the below-shown embodiments. Further, the following description and drawings are simplified as appropriate to clarify the explanation.

First Embodiment

Figure 1:
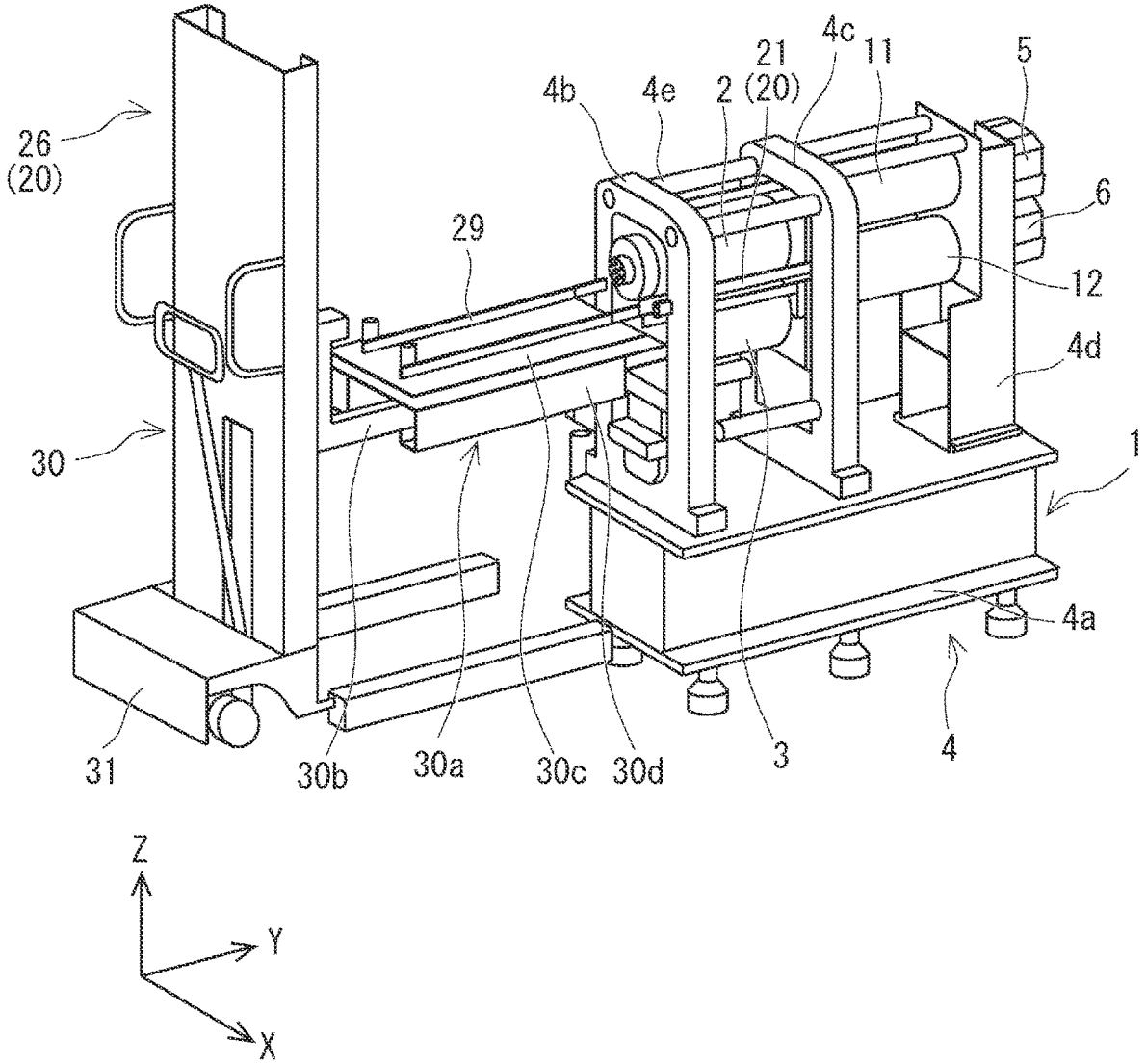
FIG. 1 shows how to replace a first roll unit of a reduction roll apparatus according to a first embodiment.
Figure 2A:
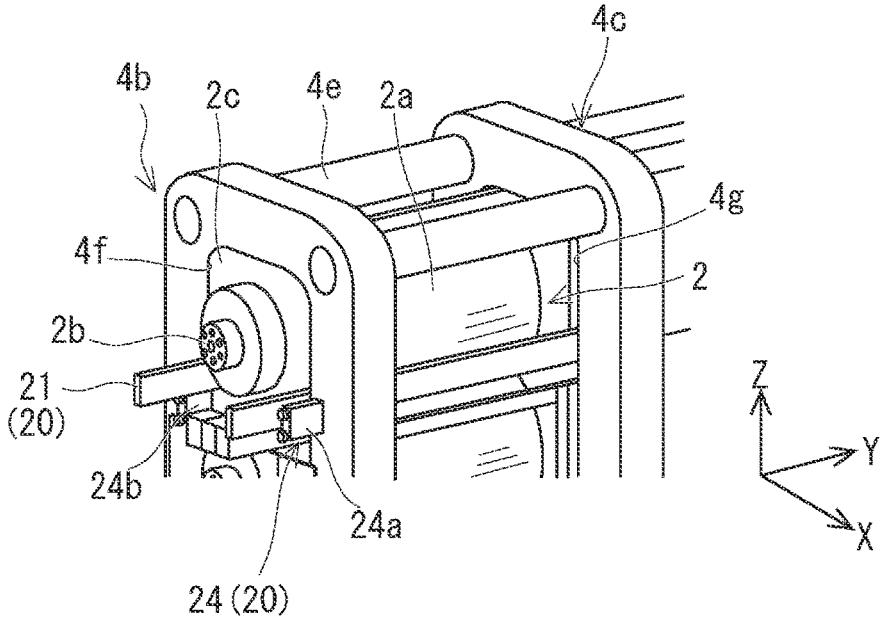
FIG. 2A is a diagram for explaining states of various parts of a roll exchange mechanism when the first roll unit of the reduction roll apparatus according to the first embodiment is replaced with a new one.
Figure 2B:
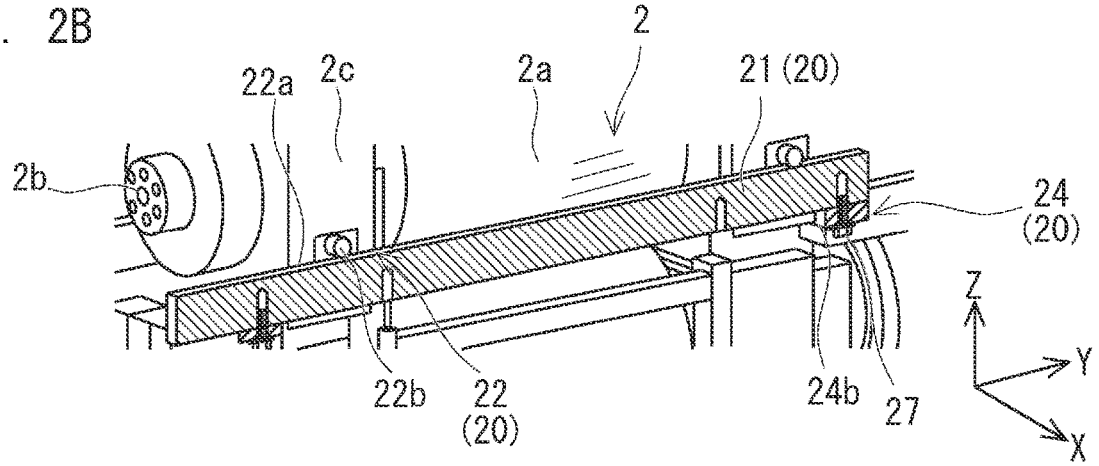
FIG. 2B is a diagram for explaining states of various parts of the roll exchange mechanism when the first roll unit of the reduction roll apparatus according to the first embodiment is replaced with a new one.
Figure 2C:
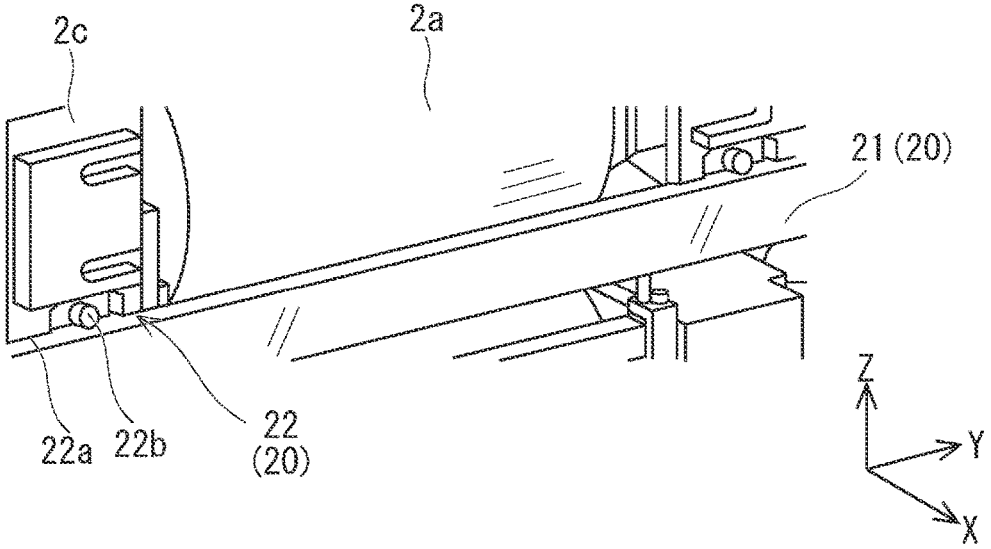
FIG. 2C is a diagram for explaining states of various parts of the roll exchange mechanism when the first roll unit of the reduction roll apparatus according to the first embodiment is replaced with a new one.
Figure 3:
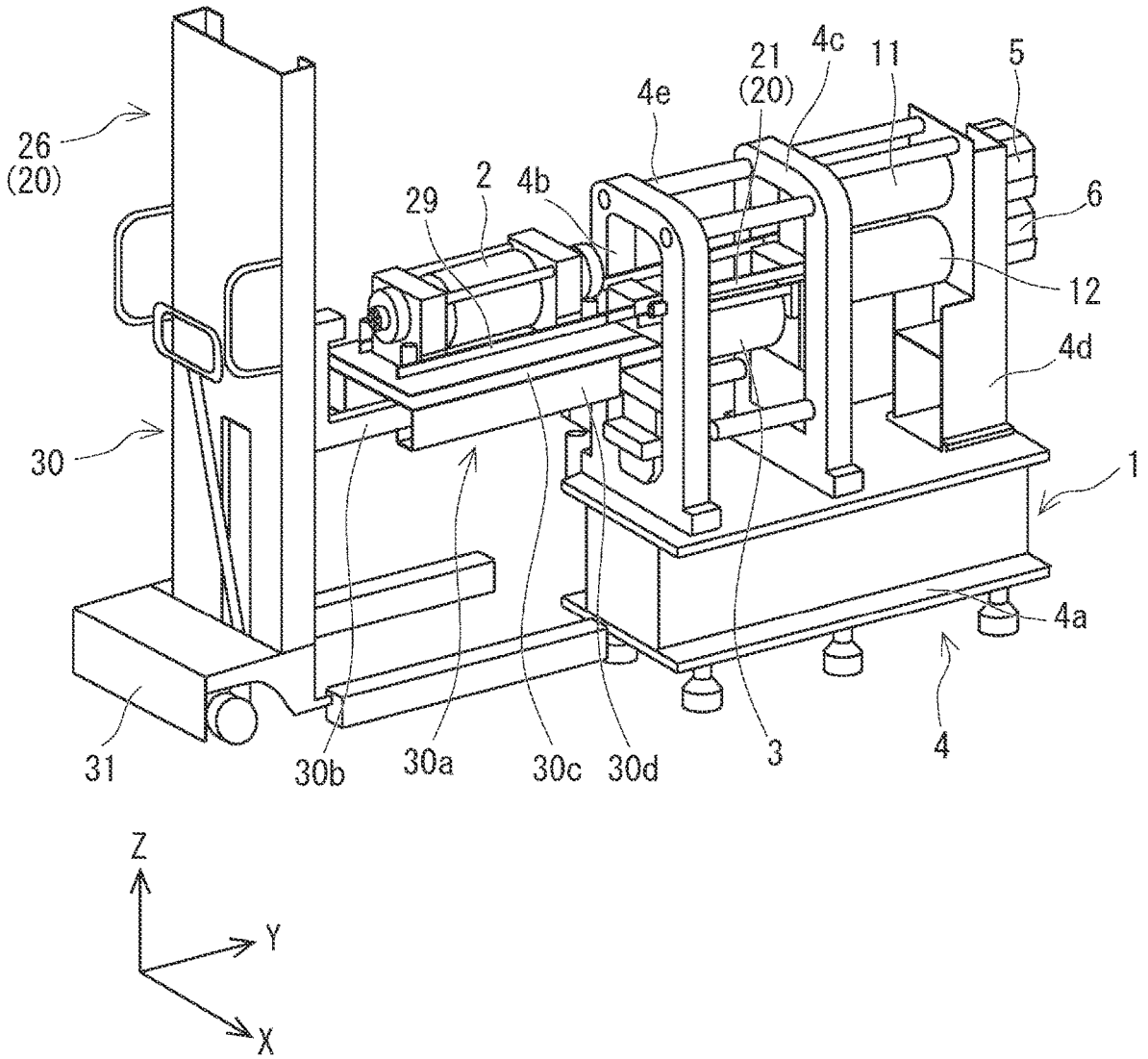
FIG. 3 shows a state in which the first roll unit has been pulled out by using the roll exchange mechanism for a reduction roll apparatus according to the first embodiment.
Figure 4A:
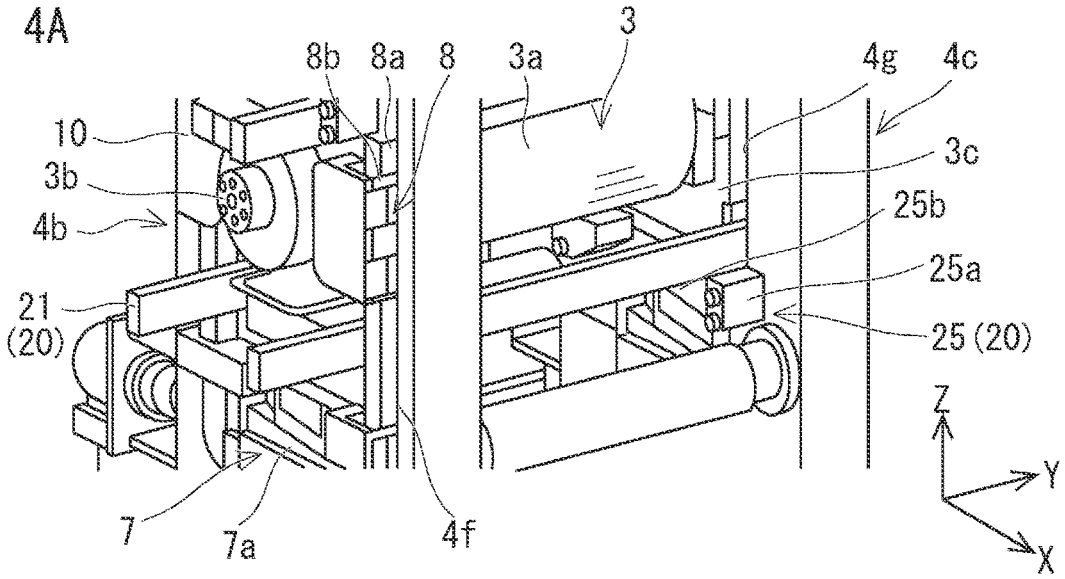
FIG. 4A is a diagram for explaining states of various parts of a roll exchange mechanism when a second roll unit of the reduction roll apparatus according to the first embodiment is replaced with a new one.
Figure 4B:
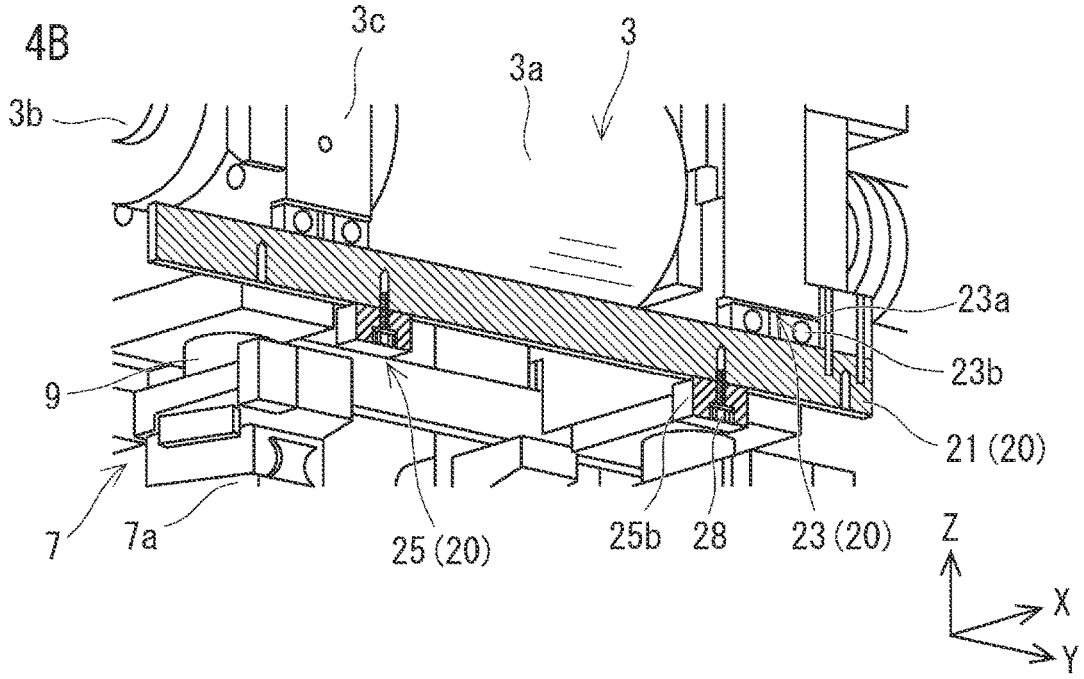
FIG. 4B is a diagram for explaining states of various parts of the roll exchange mechanism when the second roll unit of the reduction roll apparatus according to the first embodiment is replaced with a new one.
Figure 4C:
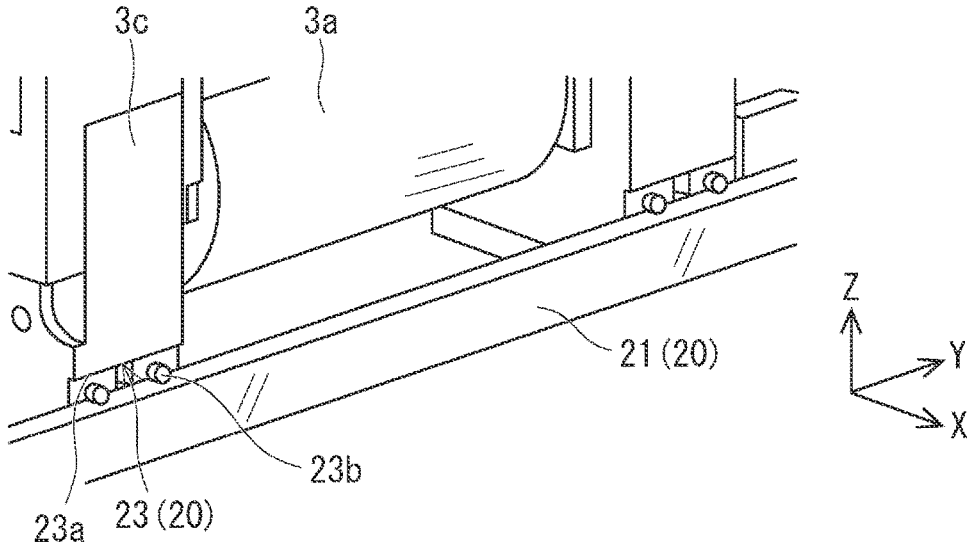
FIG. 4C is a diagram for explaining states of various parts of the roll exchange mechanism when the second roll unit of the reduction roll apparatus according to the first embodiment is replaced with a new one.
Figure 5:
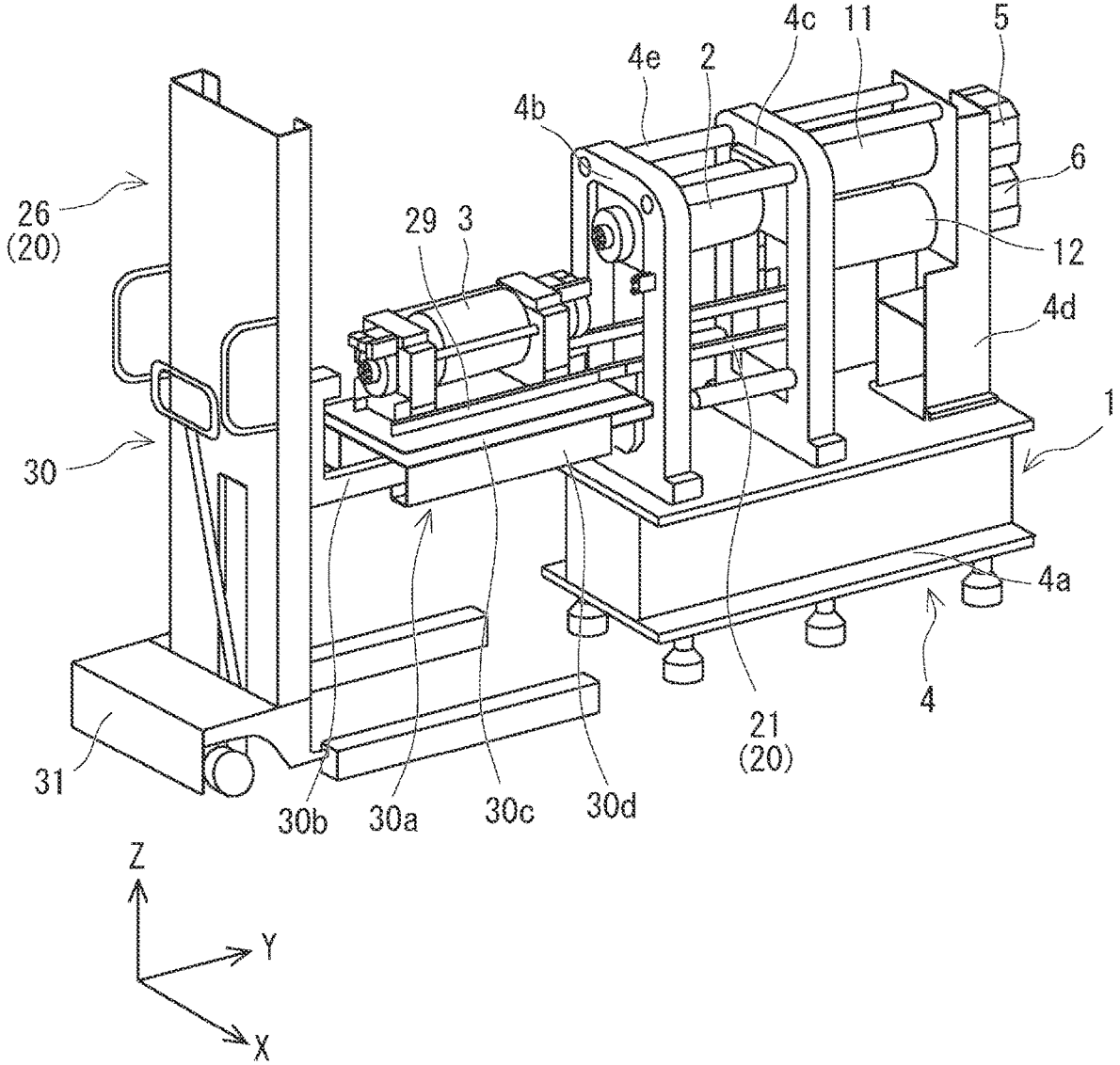
FIG. 5 shows a state in which the second roll unit is pulled out by using the roll exchange mechanism for a reduction roll apparatus according to the first embodiment.

FIG. 1 shows how to replace a first roll unit of a reduction roll apparatus according to an embodiment. FIGS. 2A, 2B, and 2C are diagrams for explaining states of various parts of a roll exchange mechanism when the first roll unit of the reduction roll apparatus according to this embodiment is replaced with a new one. FIG. 3 shows a state in which the first roll unit has been pulled out by using the roll exchange mechanism for a reduction roll apparatus according to this embodiment. FIGS. 4A, 4B and 4C are diagrams for explaining states of various parts of the roll exchange mechanism according to this embodiment when a second roll unit of the reduction roll apparatus is replaced with a new one. FIG. 5 shows a state in which the second roll unit has been pulled out by using the roll exchange mechanism for a reduction roll apparatus according to this embodiment.

Firstly, a basic configuration of a reduction roll apparatus according to this embodiment will be described. In the following description, a three-dimensional (XYZ) coordinate system is used to clarify the explanation. The reduction roll apparatus 1 can be used, for example, to roll a member to be rolled (i.e., to press and stretch a member to be pressed and stretched) such as an electrode material applied on a metal foil. As shown in FIG. 1, the reduction roll apparatus 1 includes a first roll unit 2, a second roll unit 3, an apparatus frame 4, a first motor and a second motor 6.

As shown in FIG. 2A, the first roll unit 2 includes a roller 2*a* extending in the Y-axis direction, a rotation shaft 2*b* projecting from the roller 2*a* toward the Y-axis positive and negative sides and extending in the Y-axis direction, and support frames 2*c* on the Y-axis positive and negative sides that rotatably support the rotation shaft 2*b* with bearings interposed therebetween. The outer peripheral shape of each of the support frames 2*c* is, for example, roughly rectangular as viewed from the Y-axis direction.

As shown in FIG. 1, the second roll unit 3 is disposed on the Z-axis negative side with respect to the first roll unit 2. The second roll unit 3 has a configuration roughly identical to that of the first roll unit 2, and includes a roller 3*a*, a rotation shaft 3*b*, and support frames 3*c* as shown in FIGS. 4A and 4B. The outer peripheral shape of each of the support frames 3*c* is, for example, roughly rectangular as viewed from the Y-axis direction.

As shown in FIG. 1, the apparatus frame 4 includes a pedestal 4*a*, a first support stand 4*b*, a second support stand 4*c*, a third support stand 4*d*, and beams 4*e*. The basic form of the pedestal 4*a* is, for example, a table-like shape. The first support stand 4*b* vertically extends from the pedestal 4*a* toward the Z-axis positive side. The first support stand 4*b* has a roughly rectangular annular shape as viewed from the Y-axis direction. That is, the first support stand 4*b* includes an opening 4*f* penetrating (i.e., extending) in the Y-axis direction as shown in FIGS. 2A and 4A. The opening 4*f* has, for example, a roughly rectangular shape as viewed from the Y-axis direction.

As shown in FIG. 1, the second support stand 4*c* vertically extends from the pedestal 4*a* toward the Z-axis positive side. The second support stand 4*c* has a shape roughly identical to that of the first support stand 4*b*, and includes an opening 4*g* as shown in FIGS. 2A and 4A. The second support stand 4*c* is spaced from the first support stand 4*b* and disposed on the Y-axis positive side with respect to the first support stand 4*b*. Note that the distance between the first and second support stands 4*b* and 4*c* is set to such a distance that the roller 2*a* of the first roll unit 2 and the roller 3*a* of the second roll unit 3 can be disposed between the first and second support stands 4*b* and 4*c*.

As shown in FIG. 1, the third support stand 4*d* vertically extends from the pedestal 4*a* toward the Z-axis positive side. The third support stand 4*d* is spaced from the second support stand 4*c* and disposed on the Y-axis positive side with respect to the second support stand 4*c*. The beams 4*e* serves as beams for connecting the first and second support stands 4*b* and 4*c*, and for connecting the second and third support stands 4*c* and 4*d*.

In the apparatus frame 4 having the above-described structure, as shown in FIG. 2A, in a state in which the support frame 2*c* on the Y-axis negative side of the first roll unit 2 is inserted into the opening 4*f* of the first support stand 4*b*, and the support frame 2*c* on the Y-axis positive side of the first roll unit 2 is inserted into the opening 4*g* of the second support stand 4*c*, the first roll unit 2 is fixed to the first and second support stands 4*b* and 4*c* by fastening members such as bolts. In this way, the first roll unit 2 can be attached to and detached from the first and second support stands 4*b* and 4*c*.

Meanwhile, as shown in FIG. 4A, in a state in which: the support frame 3*c* on the Y-axis negative side of the second roll unit 3 is inserted into the opening 4*f* of the first support stand 4*b*; the support frame 3*c* on the Y-axis positive side of the second roll unit 3 is inserted into the opening 4*g* of the second support stand 4*c*; and the second roll unit 3 is disposed on the Z-axis negative side with respect to the first roll unit 2, the second roll unit 3 is fixed to the first and second support stands 4*b* and 4*c* by fastening members such as bolts. In this way, the second roll unit 3 can also be attached to and detached from the first and second support stands 4*b* and 4*c*.

In some embodiments, note that the height of the second roll unit 3 in the Z-axis direction is adjustable. In some embodiments, for example, as shown in FIGS. 4A and 4B, the second roll unit 3 can be moved in the Z-axis direction along guides 8 provided on the first and second support stands 4*b* and 4*c* by an elevating unit(s) 7 that is disposed between the support frame 3*c* on the Y-axis negative side of the second roll unit 3 and the surface on the Z-axis negative side of the opening 4*f* of the first support stand 4*b*, and between the support frame 3*c* on the Y-axis positive side of the second roll unit 3 and the surface on the Z-axis negative side of the opening 4*g* of the second support stand 4*c*.

The elevating unit 7 may have any structure as long as it can move the second roll unit 3 up and down in the Z-axis direction. In some embodiments, for example, as shown in FIGS. 4A and 4B, the elevating unit 7 includes a wedge mechanism(s) of which the height in the Z-axis direction changes by moving wedges 7*a* in the X-axis direction. In some embodiments, the elevating unit 7 is controlled, for example, based on the detection result of a load detector(s) 9, such as a load cell, disposed between the elevating unit 7 and the support frame 3*c* of the second roll unit 3 so that the load that is applied to the member to be rolled when it is rolled by the roller 2*a* of the first roll unit 2 and the roller 3*a* of the second roll unit 3 becomes a preset load.

The guides 8 may have any structure as long as they can guide the second roll unit 3 in the Z-axis direction. In some embodiments, for example, as shown in FIG. 4A, the guides 8 include linear guides in which blocks 8*b* slide along rails 8*a*. The rails 8*a*, which extend in the Z-axis direction, are fixed to the opening 4*f* of the first support stand 4*b* and the opening 4*g* of the second support stand 4*c* so they face each other in the X-axis direction. Further, the support frames 3*c* of the second roll unit 3 are fixed to the blocks 8*b* by fastening members such as bolts with connecting members 10 interposed therebetween. In this way, the second roll unit 3 can be raised and lowered along the rails 8*a* according to the up/down of the elevating unit 7. Further, the second roll unit 3 can be attached to and detached from the guides 8.

The first motor 5 rotates the roller 2*a* of the first roll unit 2. As shown in FIG. 1, the first motor 5 is fixed to the third support stand 4*d*, and the driving force of the first motor 5 can be transmitted to the rotation shaft 2*b* of the first roll unit 2 through the drive shaft 11.

The second motor 6 rotates the roller 3*a* of the second roll unit 3. As shown in FIG. 1, the second motor 6 is disposed on the Z-axis negative side with respect to the first motor 5 and fixed to the third support stand 4*d*. The driving force of the second motor 6 can be transmitted to the rotation shaft 3*b* of the second roll unit 3 through the drive shaft 12. In some embodiments, note that a universal joint such as a flexible coupling is disposed between each motor and its corresponding drive shaft, or between each drive shaft and its corresponding rotation shaft of the roll unit.

Next, a configuration of a roll exchange mechanism used to replace the first roll unit 2 or the second roll unit 3 of the reduction roll apparatus 1 having the above-described configuration with a new one will be described. As shown in FIGS. 1 to 5, the roll exchange mechanism 20 includes first rail members 21, first placement parts 22, second placement parts 23, first receiving parts 24, second receiving parts 25, an opening 4*f* of the first support stand 4*b*, and a roll changing cart 26. As shown in FIGS. 2A and 4A, each of the first rail members 21 is, for example, a long member having a roughly rectangular cross section. The first rail members 21 have at least such a length in the Y-axis direction that they can span over the first and second support stands 4*b* and 4*c*.

As shown in FIGS. 2B and 2C, the first placement parts 22 are placed on the first rail members 21, which span over the first and second support stands 4*b* and 4*c*, in order to replace the first roll unit 2 with a new one. Each of the first placement part 22 includes, for example, cut-out parts 22*a* formed near both corners on the Z-axis negative side of the support frame 2*c* disposed on the Y-axis negative side of the first roll unit 2, and near both corners on the Z-axis negative side of the support frame 2*c* disposed on the Y-axis positive side of the first roll unit 2. Each of the cut-out parts 22*a* has, for example, a roughly rectangular shape as viewed from the Y-axis direction.

In some embodiments, note that as shown in FIGS. 2B and 2C, each of the first placement part 22 includes wheels 22*b* disposed at the ends on the Z-axis positive side of the cut-out parts 22*a*. Each of the wheels 22*b* is rotatable about a rotation shaft extending in the X-axis direction. In some embodiments, the wheels 22*b* are placed on the first rail members 21 when the first placement parts 22 are placed on the first rail members 21.

As shown in FIGS. 4B and 4C, the second placement parts 23 are placed on the first rail members 21, which span over the first and second support stands 4*b* and 4*c*, in order to replace the second roll unit 3 with a new one. Roughly similarly to the first placement parts 22, each of the second placement part 23 includes, for example, cut-out parts 23*a* formed near both corners on the Z-axis negative side of each of the support frames 3*c* of the second roll unit 3. Each of the cut-out parts 23*a* has, for example, a roughly rectangular shape as viewed from the Y-axis direction.

In some embodiments, note that as shown in FIGS. 4B and 4C, each of the second placement part 23 includes wheels 23*b* disposed at the ends on the Z-axis positive side of the cut-out parts 23*a*. Each of the wheels 23*b* is rotatable about a rotation shaft extending in the X-axis direction. In some embodiments, the wheels 23*b* are placed on the first rail members 21 when the second placement parts 23 are placed on the first rail member 21.

As shown in FIG. 2A, the first rail members 21, which span over the first and second support stands 4*b* and 4*c*, are placed on the first receiving parts 24 in order to replace the first roll unit 2 with a new one. Each of the first receiving parts 24 is, for example, a block member having a roughly L-shape as viewed from the Y-axis direction. That is, each of the first receiving parts 24 includes a first part 24*a* roughly parallel to the YZ-plane and a second part 24*b* roughly parallel to the XY-plane.

As shown in FIG. 2A, the first part 24*a* of the first receiving part 24 is fixed to the outer surface of the reduction roll apparatus 1, which is formed by the first and second support stands 4*b* and 4*c*, so that, in the state in which the first receiving part 24 is disposed near the first placement part 22, the second part 24*b* protrudes into the opening 4*f* of the first support stand 4*b* and the opening 4*g* of the second support stand 4*c* as viewed from the Y-axis direction.

Note that the above-described components are disposed so that, as viewed from the Y-axis direction, the first placement part 22 is aligned with the second part 24*b* of the corresponding first receiving part 24 in the Z-axis direction. Further, as viewed from the Y-axis direction, the distance between the first placement part 22 and the second part 24*b* of the corresponding first receiving part 24 in the Z-axis direction is roughly equal to the height of the first rail member 21 in the Z-axis direction. In some embodiments, note that as shown in FIG. 2B, the first rail member 21 can be fixed to the second part 24*b* of the first receiving part 24 by fastening members 27 such as bolts in the state in which the first rail member 21 is placed on the second part 24*b*.

As shown in FIG. 4A, the first rail members 21, which span over the first and second support stands 4*b* and 4*c*, are placed on the second receiving parts 25 in order to replace the second roll unit 3 with a new one. Each of the second receiving parts 25 is, for example, roughly identical to the first receiving part 24, i.e., is a block member having a roughly L-shape as viewed from the Y-axis direction. That is, each of the second receiving parts 25 includes a first part 25*a* roughly parallel to the YZ-plane and a second part 25*b* roughly parallel to the XY-plane.

As shown in FIG. 4A, the first part 25*a* of the second receiving part 25 is fixed to the inner surface of the reduction roll apparatus 1, which is formed by the first and second support stands 4*b* and 4*c*, so that, in the state in which the second receiving part 25 is disposed near the second placement part 23, the second part protrudes into the opening 4*f* of the first support stand 4*b* and the opening 4*g* of the second support stand 4*c* as viewed from the Y-axis direction.

Note that the above-described components are disposed so that, as viewed from the Y-axis direction, the second placement part 23 is aligned with the second part 25*b* of the corresponding second receiving part 25 in the Z-axis direction. Further, as viewed from the Y-axis direction, the distance between the second placement part 23 and the second part 25*b* of the corresponding second receiving part 25 in the Z-axis direction is roughly equal to the height of the first rail member 21 in the Z-axis direction. Further, the distance between the first rail members 21 in the X-axis direction when the first rail members 21 are placed on the second receiving parts 25 is roughly equal to the distance between them in the X-axis direction when the first rail members 21 are placed on the first receiving parts 24. In some embodiments, not that as shown in FIG. 4B, the first rail member 21 can be fixed to the second part 25*b* of the second receiving part 25 by fastening members 28 such as bolts in the state in which the first rail member 21 is placed on the second part 25*b*.

The opening 4*f* of the first support stand 4*b* has such a shape that the first and second roll units 2 and 3 can be inserted therethrough in the Y-axis direction, and has, for example, a roughly rectangular shape as viewed from the Y-axis direction as described above. However, the shape of the opening 4*f* of the first support stand 4*b* is not limited to any particular shapes as long as it has such a shape that the first and second roll units 2 and 3 can be inserted therethrough in the Y-axis direction.

As shown in FIG. 1, the roll changing cart 26 includes second rail members 29, an elevating unit 30, and a cart main body 31. Each of the second rail members 29 has a shape roughly identical to that of the first rail member 21, and is, for example, a long member having a roughly rectangular cross section. Further, two second rail members 29 are disposed with a distance therebetween which is roughly equal to the distance between the first rail members 21 in the X-axis direction when the first rail members 21 are placed on the first receiving parts 24 or the second receiving parts 25.

As shown in FIGS. 3 and 5, the elevating unit 30 raises and lowers a fork 30*b* that supports a placement platform 30*a* in the Z-axis direction. As the elevating unit 30, an elevating apparatus roughly identical to an ordinary forklift can be used. The placement platform 30*a* includes a placement platform main body 30*c* and insertion parts 30*d*.

The placement platform main body 30*c* has, for example, a roughly planar shape, and the two second rail members 29 are fixed to the surface on the Z-axis positive side of the placement platform main body 30*c*. The fork 30*b* is inserted into the insertion parts 30*d*. Each of the insertion parts 30*d* has, for example, a cylindrical shape, and they are fixed to the surface on the Z-axis negative side of the placement platform main body 30*c* with a distance therebetween which is roughly equal to the distance between two prongs of the fork 30*b*. The cart main body 31 supports the elevating unit 30. Further, wheels are provided on the undersurface of the cart main body 31. In this way, the roll changing cart 26 can be moved freely.

Next, a flow for replacing the first roll unit 2 with a new one by using the roll exchange mechanism 20 according to this embodiment will be described. Firstly, as shown in FIGS. 1 and 2A, the first rail members 21 are inserted from the opening 4*f* of the first support stand 4*b* of the apparatus frame 4 toward the Y-axis positive side, and disposed roughly parallel to the rotation shaft 2*b* of the first roll unit 2. By doing so, the first rail members 21 are placed on the second parts 24*b* of the first receiving parts 24.

In this state, in some embodiments as shown in FIG. 2B, the first rail members 21 are fixed to the second parts 24*b* of the first receiving parts 24 with fastening members 27. In some embodiments, the first placement parts 22 provided in the first support frame 2*c* of the first roll unit 2 are roughly in contact with the first rail members 21.

Next, as shown in FIG. 3, the roll changing cart 26 is moved closer to the reduction roll apparatus 1, so that the first rail members 21 and the second rail members 29 of the roll changing cart 26 are roughly connected (i.e., roughly aligned) with each other in the Y-axis direction. In some embodiments, note that the first and second rail members 21 and 29 are connected to each other by using connecting members.

Next, the fastening members that fixes the first roll unit 2 to the first and second support stands 4*b* and 4*c* are loosened, so that the first roll unit 2 is disengaged from the first and second support stands 4*b* and 4*c*.

As a result, as shown in FIG. 2C, the first placement parts 22 disposed on the first support frame 2*c* of the first roll unit 2 are placed on the first rail members 21. Note that when the first placement parts 22 are equipped with wheels 22*b*, the wheels 22*b* are placed on the first rail members 21.

Next, the first roll unit 2 is disengaged from the drive shaft 11. Then, for example, by human power (alternatively, by using an actuator that can expand and contract in the Y-axis direction), the first roll unit 2 is moved toward the Y-axis negative side along the first and second rail members 21 and 29, and the first roll unit 2 is pulled outside of the reduction roll apparatus 1 through the opening 4*f* of the first support stand 4*b* and placed on the placement platform 30*a* of the roll changing cart 26.

After that, for example, the first roll unit 2 is connected to the second rail members 29 of the roll changing cart 26 by using connecting members, so that the first roll unit 2 is fixed to the roll changing cart 26. Then, in this state, the roll changing cart 26 is carried out (i.e., moved) to a predetermined position.

Meanwhile, a flow for pushing and attaching the first roll unit 2 to the reduction roll apparatus 1 can be carried out in a reversed flow to the above-described flow for detaching and pulling the first roll unit 2 from the reduction roll apparatus 1. In this way, only the first roll unit 2 of the first and second roll units 2 and 3 can be replaced with a new one.

Next, a flow for replacing the second roll unit 3 by using the roll exchange mechanism 20 according to this embodiment will be described. Firstly, as shown in FIG. 4A, the first rail members 21 are inserted from the opening 4*f* of the first support stand 4*b* of the apparatus frame 4 toward the Y-axis positive side, and disposed roughly parallel to the rotation shaft 3*b* of the second roll unit 3. By doing so, the first rail members 21 are placed on the second parts 25*b* of the second receiving parts 25.

In this state, in some embodiments as shown in FIG. 4B, the first rail members 21 are fixed to the second parts 25*b* of the second receiving parts 25 with fastening members 28. In some embodiments, the second placement parts 23 provided in the first support frame 3*c* of the second roll unit 3 are roughly in contact with the first rail members 21.

Next, as shown in FIG. 5, the roll changing cart 26 is moved closer to the reduction roll apparatus 1, so that the first rail members 21 and the second rail members 29 of the roll changing cart 26 are roughly connected (i.e., roughly aligned) with each other in the Y-axis direction. In some embodiments, note that the first and second rail members 21 and 29 are connected to each other by using connecting members.

Next, the fastening members that fixes the second roll unit 3 to the first and second support stands 4*b* and 4*c* are loosened, so that the second roll unit 3 is disengaged from the first and second support stands 4*b* and 4*c*. As a result, as shown in FIG. 4C, the second placement parts 23 disposed on the second support frame 3*c* of the first roll unit 3 are placed on the first rail members 21.

Note that when the second placement parts 23 are equipped with wheels 23*b*, the wheels 23*b* are placed on the first rail members 21. Further, when the reduction roll apparatus 1 is equipped with guides 8, the fastening members that fix the support frame 3*c* of the second roll unit 3 to the blocks 8*b* of the guides 8 are loosened, so that the second roll unit 3 is disengaged from the blocks 8*b* of the guides 8. In some embodiments, when the reduction roll apparatus 1 is equipped with the elevating unit 7, the elevating unit 7 is lowered vertically in the Z-axis direction, so that the second roll unit 3 is lowered in the Z-axis direction.

Next, the second roll unit 3 is disengaged from the drive shaft 12. Then, for example, by human power, the second roll unit 3 is moved toward the Y-axis negative side along the first and second rail members 21 and 29, and the second roll unit 3 is pulled outside of the reduction roll apparatus 1 through the opening 4*f* of the first support stand 4*b* and placed on placement platform 30*a* of the roll changing cart 26.

After that, for example, the second roll unit 3 is connected to the second rail members 29 of the roll changing cart 26 by using connecting members, so that the second roll unit 3 is fixed to the roll changing cart 26. Then, in this state, the roll changing cart 26 is carried out (i.e., moved) to a predetermined position.

Meanwhile, a flow for pushing and attaching the second roll unit 3 to the reduction roll apparatus 1 can be carried out in a reversed flow to the above-described flow for detaching and pulling the second roll unit 3 from the reduction roll apparatus 1. In this way, only the second roll unit 3 of the first and second roll units 2 and 3 can be replaced with a new one.

As described above, the roll exchange mechanism 20 for the reduction roll apparatus 1 according to this embodiment can selectively replace only one of the first and second roll units 2 and 3.

In addition, for example, it is possible to, by human power, move the first roll unit 2 or the second roll unit 3 in the Y-axis direction along the first rail members 21, pull or push it through the opening 4*f* of the first support stand 4*b* of the apparatus frame 4, and thereby replace it with a new one. Therefore, it is possible to replace the first roll unit 2 or the second roll unit 3 with a new one by using the roll exchange mechanism 20 having a simple structure as described above without using large equipment such as a hoist crane, which is typically used in the work for replacing an ordinary roller with a new one, thus making it possible to contribute to simplifying the work for replacing the first roll unit 2 or the second roll unit 3. Further, as the work for replacing the first roll unit 2 or the second roll unit 3 is simplified, it also contributes to the reduction of the cost required for the replacement work.

Further, when the first placement parts 22 are equipped with wheels 22*b*, the first roll unit 2 can be easily moved along the first rail members 21. Further, when the second placement parts 23 are equipped with wheels 23*b*, the second roll unit 3 can be easily moved along the first rail members 21. Further, when the roll exchange mechanism 20 is equipped with the roll changing cart 26, the first roll unit 2 or the second roll unit 3 can be easily replaced with a new one by using the roll changing cart 26.

Second Embodiment

Figure 6:
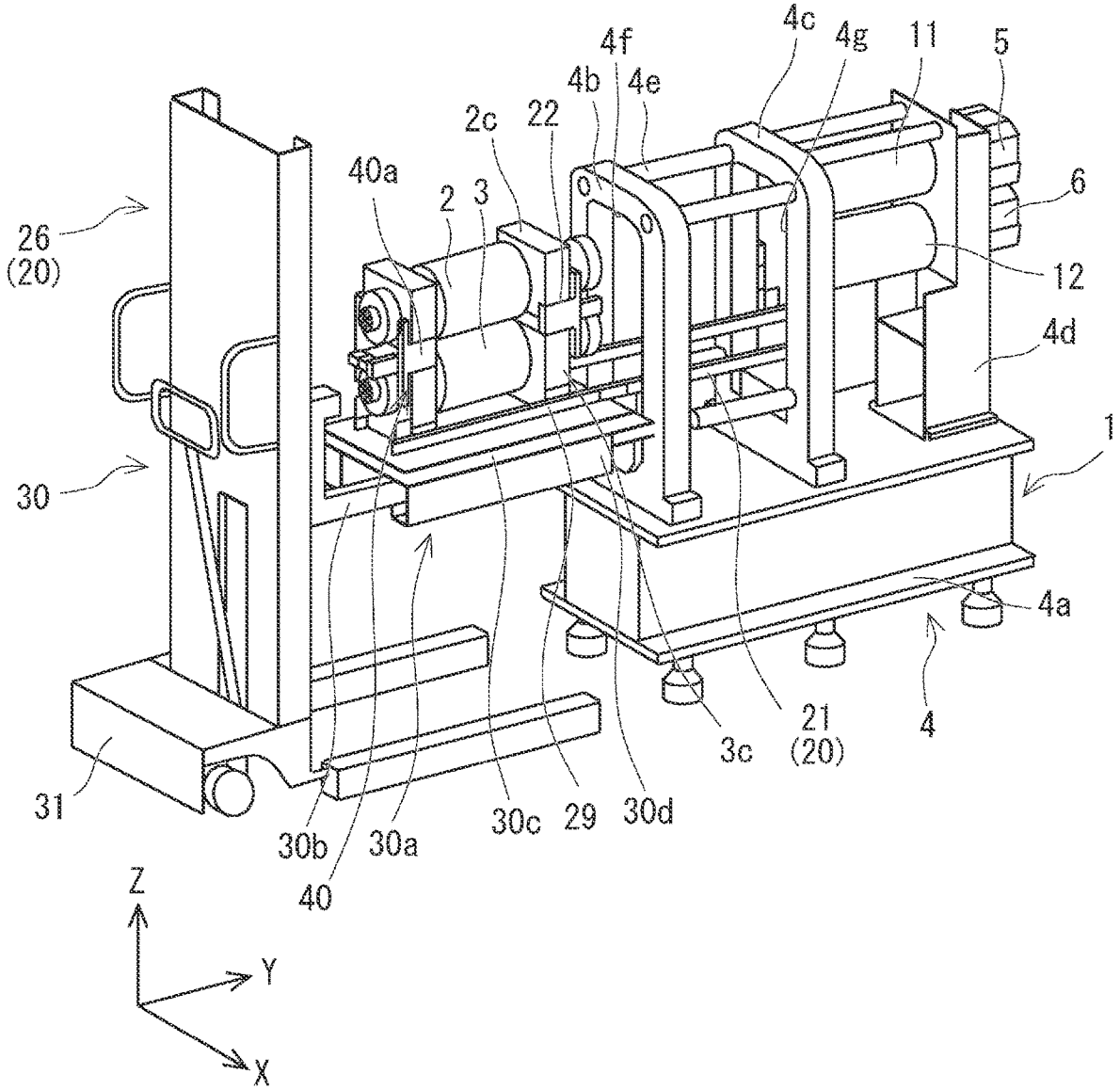
FIG. 6 shows a state in which the first and second roll units are pulled out together by using the roll exchange mechanism for a reduction roll apparatus according to the second embodiment.

FIG. 6 shows a state in which first and second roll units are pulled out together by using a roll exchange mechanism for a reduction roll apparatus according to this embodiment. The roll exchange mechanism according to this embodiment is suitable when the first and second roll units 2 and 3 are replaced together.

In particular, as shown in FIG. 6, the roll exchange mechanism according to this embodiment includes a connecting member 40 that connects the first and second roll units 2 and 3 to each other in addition to the components/structures of the roll exchange mechanism 20 according to the first embodiment. In some embodiments, note that the connecting member 40 includes a space keeping part disposed between the support frame 2*c* of the first roll unit 2 and the support frame 3*c* of the second roll unit 3 in order to prevent the roller 2*a* of the first roll unit 2 and the roller 3*a* of the second roll unit 3 from colliding against each other.

When the first and second roll units 2 and 3 are exchanged together by using the above-described roll exchange mechanism, it is roughly similar to the above-described method for exchanging the second roll unit 3 by using the roll exchange mechanism 20 according to the first embodiment, so the detailed description thereof is omitted. However, as shown in FIG. 6, the support frame 2*c* of the first roll unit 2 and the support frame 3*c* of the second roll unit 3 are connected to each other by using the connecting member 40 with the space keeping part 40*a* being inserted between the support frame 2*c* of the first roll unit 2 and the support frame 3*c* of the second roll unit 3. Then, the first and second roll units 2 and 3, which are connected to each other, can be replaced together with new ones by moving the first and second roll units 2 and 3 in the Y-axis direction along the first rail members 21 placed on the second receiving parts 25.

The present disclosure is not limited to the above-described embodiments, and they can be modified as desired without departing from the scope and spirit of the disclosure.

For example, although the first placement parts 22 are formed in the support frame 2*c* of the first roll unit 2, they may be provided as separate members. In such a case, it is sufficient if the first placement parts 22 are disposed in the support frame 2*c* when the first roll unit 2 is placed on the first rail members 21. In short, the first placement parts 22 may have any shapes as long as the first roll unit 2 can be placed on the first rail members 21. The same applies to the second placement parts 23.

For example, the first receiving parts 24 may have any shapes as long as the first rail member 21 can be placed thereon, and it is sufficient if the first rail members 21 are disposed on the apparatus frame 4 when the first rail members 21 are placed on the first receiving parts 24. The same applies to the second receiving parts 25.

For example, although the reduction roll apparatus 1 according to this embodiment includes the first and second roll units 2 and 3, the reduction roll apparatus 1 may include any number of roll units.

From the disclosure thus described, it will be obvious that the embodiments of the disclosure may be varied in many ways. Such variations are not to be regarded as a departure from the spirit and scope of the disclosure, and all such modifications as would be obvious to one skilled in the art are intended for inclusion within the scope of the following claims.

What is claimed is:

1. An assembly comprising:

a reduction roll apparatus comprising:

a first roll unit including a first roller;

a rotation shaft of the first roller;

a support frame configured to support the rotation shaft; and an apparatus frame to which the support frame is detachably connected;

a roll exchange mechanism comprising:

a first rail member disposed parallel to the rotation shaft;

a placement part disposed in the support frame and placed on the first rail member; and a receiving part disposed in the apparatus frame and configured so that the first rail member is placed thereon; and a roll changing cart comprising:

a second rail member configured to be connected to the first rail member;

an elevating unit configured to raise and lower the second rail member; and a cart main body configured to support the elevating unit; and wherein an opening is formed in a part of the apparatus frame and configured so that the first roll unit can be inserted therein and removed therefrom, the part of the apparatus frame being located at an end thereof in a direction in which the rotation shaft extends; and wherein the first roll unit can be pulled outside of the reduction roll apparatus or pushed inside of the reduction roll apparatus along the first rail member through the opening of the apparatus frame.

* * * * *